US006669756B2

(12) United States Patent
Urabe et al.

(10) Patent No.: US 6,669,756 B2
(45) Date of Patent: Dec. 30, 2003

(54) DISCHARGE APPARATUS FOR MOVABLE HEARTH TYPE HEAT-TREATMENT FURNACE, ITS OPERATION METHOD, AND METHOD AND APPARATUS FOR MANUFACTURING MOLTEN IRON USING THE SAME

(75) Inventors: Yoshihiro Urabe, Osaka (JP); Takao Umeki, Osaka (JP); Masahiko Tetsumoto, Osaka (JP); Toshikatsu Uchida, Osaka (JP); Sumito Hashimoto, Osaka (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 1 day.

(21) Appl. No.: 09/916,588

(22) Filed: Jul. 30, 2001

(65) Prior Publication Data

US 2002/0024172 A1 Feb. 28, 2002

(30) Foreign Application Priority Data

Jul. 31, 2000 (JP) ..... 2000-230961
Nov. 15, 2000 (JP) ..... 2000-348210

(51) Int. Cl.[7] ..... C21B 13/14

(52) U.S. Cl. ..... 75/484; 75/10.63; 75/500; 266/177; 266/195

(58) Field of Search ..... 75/484, 10.63, 75/500; 266/177, 195

(56) References Cited

U.S. PATENT DOCUMENTS 6,319,302 B1 * 11/2001 Harada ..... 75/484
6,395,052 B1 * 5/2002 Schrey et al. ..... 75/10.38

FOREIGN PATENT DOCUMENTS

| | | |
|---|---|---|
| DE | 555 573 | 7/1932 |
| DE | 39 27 579 | 2/1991 |
| EP | 0 989 194 | 3/2000 |
| FR | 2 134 752 | 12/1972 |
| GB | 2 111 934 | 7/1983 |
| WO | WO 00/26420 | 5/2000 |

OTHER PUBLICATIONS

Hoffman et al Patent Application Publication No.US 2001/0054329 A1 Dec 27, 2001.*

* cited by examiner

*Primary Examiner*—Melvyn Andrews
(74) *Attorney, Agent, or Firm*—Oblon, Spivak, McClelland, Maier & Neustadt, P.C.

(57) ABSTRACT

Heat-treated products discharged from a discharge port of a movable hearth type heat treatment furnace, for example a rotary hearth type reduction furnace are discharged to a sorting means, the heat-treated products that foreign substances have been removed, are discharged through a seal leg into which anti-reoxidation gas is blown from a gas blowing nozzle, to a receiving recess of a receiving pan provided within a case having a hopper attached thereto which is a feeding means, and then a scraper is swung to discharge the heat-treated products deposited on the top surface of the receiving recess from the longitudinal ends of the receiving pan and simultaneously to quantitatively feed it to a molten iron-manufacturing furnace 8, which is a downstream side facility, from the bottom side discharge port of the casing having a hopper attached thereto, and in addition, dust removal/cooling means for produced gas of the molten iron-manufacturing furnace and means for regulating the amount of produced gas are provided.

30 Claims, 4 Drawing Sheets

DISCHARGE APPARATUS FOR MOVABLE HEARTH TYPE HEAT-TREATMENT FURNACE, ITS OPERATION METHOD, AND METHOD AND APPARATUS FOR MANUFACTURING MOLTEN IRON USING THE SAME

BACKGROUND OF THE INVENTION

1. Field of the Invention

The present invention relates to a discharge apparatus for a movable hearth type heat treatment furnace and its operation method. The present invention also relates to a method of manufacturing molten iron by reducing raw material formed from at least powdered iron oxide-containing material and powdered carbonaceous reducing agent to manufacture reduced iron using a rotary hearth type reduction furnace and the like as a movable hearth type heat treatment furnace, and then reducing and melting the reduced iron in a molten iron-manufacturing furnace.

2. Description of the Invention

Recently, a movable hearth type heat treatment furnace, for example, a rotary hearth type reduction furnace has been widely used for manufacturing reduced iron or metallic iron by reducing raw material which comprises iron ore or dust of an iron foundry, the other waste, coal and the like as components. The movable hearth type heat treatment furnace for manufacturing reduced iron or metallic iron reduces raw material on the movable hearth or additionally heats raw material after reduced, thereby melting and separating iron and slag. And, although a discharge apparatus is provided for discharging reduced iron that is highly reoxidizable or metallic iron that has no reoxidation problem (to be referred as heat-treated products), carbonaceous powder, and slag mixture, which are discharged from a discharge port out of the furnace, various types of such a discharge apparatus for movable hearth type heat treatment furnace have been known.

For example, a known discharge apparatus consists of a chute located between a discharge port for heat-treated products of movable hearth type heat treatment furnace and a downstream side facility, and high temperature switching valves having two or more stages for preventing outflow of high temperature gas from the movable hearth type heat treatment furnace, the valves having a well-known construction. That is, the discharge apparatus is constructed to feed heat-treated products discharged from the furnace into the downstream side facility simultaneously with discharging heat-treated products out of the furnace, while preventing outflow of high temperature gas from the movable hearth type heat treatment furnace by mutual on-off operations of high temperature switching valves.

In addition, another known discharge apparatus consists of a chute located between the discharge port for discharging heat-treated products of the movable hearth type heat treatment furnace and a detachable sealed container, and high temperature switching valves of well-known construction in the way of chute.

Yet another known discharge apparatus consists of a chute, of which one end is connected to the discharge port for discharging heat-treated products of the movable hearth type heat treatment furnace, and the other end is provided with a quantitative discharge apparatus such as a vibration feeder, a screw conveyor, or a pan conveyor.

Conventionally, molten pig iron was manufactured mainly by a blast furnace method. The blast furnace method is a method in which raw material of massive iron ore and coke are charged from the top portion of furnace and hot reducing gas is produced by blowing hot blast from a tuyere provided in the bottom portion of furnace to burn the coke, thereby reducing and melting the iron oxide. Although the blast furnace method is a process having a very good efficiency, it has a drawback in that it requires massive raw material and reducing agent. That is, because the feeding of massive ore as raw material is tight, it is inevitable to use powdered ore after forming it into sintered ore or pellets and thus a sintering machine or a facility for manufacturing pellets is needed. In addition, because reducing agent is used after carbonized and coked, strongly caking coal that is expensive is needed as coal for manufacturing coke besides a coke furnace. Furthermore, in these facilities, because it is supposed that cost for measuring pollution will be increased suddenly as environmental regulation is strengthened from now on, thereby cost needed for processing raw material and reducing agent in advance will be increased, and as a result, there will be a problem that cost of molten pig iron will be increased.

Recently, methods of manufacturing molten pig iron directly from powdered iron ore and coal material which do not require or simplify a facility for processing such raw material and fuel in advance, have been developed. Among them, it is noted that various methods of manufacturing molten pig iron have been proposed and paid attention, in which a mixture of powdered iron ore and coal material is pre-reduced in the aforementioned movable hearth type heat treatment furnace, for example, a rotary hearth type heat treatment furnace, so that reduced iron is manufactured, and the reduced iron is discharged by the aforementioned discharge apparatus and the like, and then reduced and molten in a smelting furnace.

For example, finely powdered iron ore and finely powdered carbonaceous material are formed into a briquette shape and these formed products are pre-reduced into reduced iron in a rotary hearth furnace as a pre-reduction furnace and are discharged from the furnace at least at a temperature which is not lower than 1000° C. Meanwhile, a smelting furnace, within which metallic bath exists and which blows oxygen into the furnace simultaneously introducing finely powdered carbonaceous material onto the surface of bath, is prepared, the aforementioned reduced iron is charged into the smelting furnace, and reducing and melting are performed. In this case, the exhaust gas of smelting furnace is recovered and introduced into a rotary hearth furnace, which is a pre-reduction furnace, as fuel for pre-reducing the formed products.

Also, powdered iron oxide and powdered solid-reducing agent are mixed, the mixture obtained thereby is pre-reduced in the powdered state as it is without being conglomerated thereby producing reduced iron, and then discharged from the furnace at a temperature of at least 500° C. Meanwhile, a filled-in layer of coal material exists in the furnace, conglomerated granular coal material is charged from the top portion of the furnace, and the reduced iron is charged into a shaft furnace that generates reducing gas by blowing oxygen-containing gas from a tuyere provided in the bottom portion of the furnace to burn coal material in front of the tuyere, whereby reducing and melting are performed. An this time, some cases recover produced gas of the shaft furnace and charge a part of it into the rotary hearth furnace, which is a pre-reduction furnace, as fuel.

Furthermore, some cases pre-reduce raw pellets consisting of iron ore, carbon-containing reducing agent and slag-forming material to form self-fluxing reduced iron, charge the self-fluxing reduced iron into a submerged arc furnace, and perform reduction and melting while melting and separating slag during a temperature-rising process, thereby manufacturing molten pig iron, of which the concentration of carbon is 1? 5%.

Although the above prior arts are excellent, at first, there are problems in connection with the means for feeding reduced iron discharged from the rotary hearth furnace into the smelting furnace as follows:

Firstly, as to the discharge apparatus of movable hearth type heat treatment furnace, because the heat-treated products discharged from the exhaust port of movable hearth type heat treatment furnace have a high temperature maximum above 1000° C. and in addition thereto powder (carbonaceous powder) is also discharged, troubles such as blockage and adherence are liable to be occurred in the high temperature switching valves and it is difficult to continue stable operation. In addition, the discharge of heat-treated products by the high temperature switching valve is intermittent, and in particular there is a problem to be solved in that continuous melting is impossible if a melting furnace is located in the downstream side, whereby improvement in productivity of reduced iron or metallic iron cannot be expected.

In addition, it is difficult to make the movable hearth type heat treatment furnace and the chute located between the movable hearth type heat treatment furnace and the detachable sealed container in a completely sealed construction, and in particular there is a possibility that ambient air may be flown into the movable hearth type heat treatment furnace if the movable hearth type heat treatment furnace is operated under a negative pressure. That is, if ambient air is flown into the movable hearth type heat treatment furnace, there will be such problems that the reduced iron will be reoxidized thereby deteriorating the product value, and simultaneously the reduced iron will be molten and welded or carbonaceous powder will be burnt by heat generated at the oxidation, whereby discharge will be difficult and the product value will be deteriorated.

While there is an advantage in that the heat-treated products can be quantitatively discharged, there is a problem in connection with resistance to high temperature and air tightness in the vibration feeder, screw conveyor, pan conveyor and the like and there is occurred such problems that the reduced iron is reoxidized thereby deteriorating the product value, and simultaneously the reduced iron is molten and welded or carbonaceous powder is burnt by heat generated at the oxidation. Furthermore, although the screw conveyor is most excellent in air tightness among the vibration feeder, screw conveyor, pan conveyor and the like, the screw conveyor has a problem to be solved in that because a screw shaft directly contacts with heat-treated products of high temperature due to its construction, loss caused by abrasion is violent and thus maintenance cost is increased, besides the problem of heat resistance.

Next, although it is rare case, it has been found that foreign substances reached maximum up to tens of centimeters are entrained in the reduced iron. These foreign substances are those dropped from refractory material or accretion, or metallic iron plate produced on the hearth and the like, and it is practically impossible to completely remove these foreign substances.

However, the entrainment of such foreign substances was not considered at all in the prior art and thus it is supposed that there may be problems as follows: as explained in the above, if foreign substances of a large size are entrained in reduced iron, they are entangled in a chute or charging port of shaft furnace, so that blockage is likely to be occurred and the feeding of reduced iron to a smelting furnace will be hindered. In addition, if the internal diameter of chute is enlarged so that foreign substances shall not entangled in the chute, the foreign substances will be charged into the smelting furnace, whereby there will be problems in that if the foreign substances are peeled-off refractory material, they will block a molten pig iron tapping port or a residue discharge port at the time of tapping the molten pig iron or discharging residues, whereby molten pig iron or slag cannot be discharged. And, when melting and smelting are performed using an electrode, it is required to feed reduced iron around the electrode, but if the diameter of chute is too large, the reduced iron is dispersed in the furnace and is not melt so effectively. Also, there may be problems in that the foreign substances contact with and impair the electrode and in that if the foreign substances are nonconductors such as peeled-off refractory material, they hinder the flow of electricity, thereby causing deterioration of productivity.

Furthermore, in connection with dealing with the influences to be happened to the operation of rotary hearth furnace, when the amount of gas produced in a smelting furnace is varied either due to variations in the amount of reduced iron fed to the smelting furnace and metallization rate, or due to an abnormal operation when tapping molten pig iron, discharging residues from the smelting furnace and the like, no measure was taken into consideration at all.

SUMMARY OF THE INVENTION

It is an object of the present invention to provide a discharge apparatus for movable hearth type heat treatment furnace, which can quantitatively and continuously discharge reduced iron, without hindering the operation of movable hearth type heat treatment furnace and a downstream side facility, and without reoxidizing the reduced iron even when discharging reduced iron which is highly reoxidizable, and furthermore which can reduce the wearing-out of constituent components, and to provide a method of operating the movable hearth type heat treatment furnace.

And, it is another object of the present invention to provide a method and apparatus for manufacturing molten pig iron using a combination of a rotary hearth furnace and a smelting furnace, wherein reduced iron manufactured in the rotary hearth furnace can be continuously fed into the smelting furnace in a state of high temperature while preventing foreign substances from being charged into the smelting furnace and produced gas generated in the smelting furnace may be efficiently used as reducing fuel for the rotary hearth furnace without influencing the operation of the rotary hearth furnace even if the amount of the produced gas is varied.

The present invention is a discharge apparatus for a movable hearth type heat treatment furnace which discharges heat-treated products from the movable hearth type heat treatment furnace to a downstream side facility, characterized in that the discharge apparatus comprises, in a casing, a recessed retaining member provided with a receiving recess for receiving and temporarily retaining the heat-treated products discharged from said movable hearth type heat treatment furnace, and a scraper that reciprocates along a surface of said receiving recess and discharges said heat-treated products retained in the receiving recess into said casing.

Said discharge apparatus is the discharge apparatus for a movable hearth type heat treatment furnace characterized in that a seal leg is provided between said movable hearth type heat treatment furnace and said recessed retaining member, for introducing the heat-treated products discharged from said movable hearth type heat treatment furnace into the receiving recess of said recessed retaining member.

Said discharge apparatus is the discharge apparatus for a movable hearth type heat treatment furnace characterized in that a gas blowing nozzle for blowing anti-reoxidation gas into said casing is communicated with said seal leg.

Said discharge apparatus is the discharge apparatus for a movable hearth type heat treatment furnace characterized in that a screen sizer is provided between said movable hearth type heat treatment furnace and said seal leg, for sorting foreign substances in the heat-treated products and discharging them out of the system The present invention is an apparatus for manufacturing molten iron characterized in that it comprises a movable hearth type heat treatment furnace for obtaining reduced iron by reducing raw material formed by mixing at least powdered iron oxide-containing material and powdered carbonaceous reducing agent, a sorting means for removing foreign substances entrained in said reduced iron discharged from said movable hearth type heat treatment furnace, and a molten iron-manufacturing furnace for obtaining molten iron by melting said reduced iron in which said foreign substances have been removed by the sorting means.

Said apparatus for manufacturing molten iron is characterized in that it comprises a feeding means for feeding said reduced iron to said molten iron-manufacturing furnace while maintaining the seal portion with said reduced iron in which said foreign substances have been removed by said sorting means.

Said apparatus for manufacturing molten iron is characterized in that said feeding means feeds said reduced iron to said molten iron-manufacturing furnace by said discharge apparatus.

Said apparatus for manufacturing molten iron is characterized in that it comprises a gas recovery means for introducing at least a part of produced gas generated in said molten iron-manufacturing furnace into said movable hearth type heat treatment furnace as fuel for reduction.

Said apparatus for manufacturing molten iron is characterized in that said gas recovery means introduces said produced gas into the first half of reduction of said movable hearth type heat treatment furnace.

Said apparatus for manufacturing molten iron is characterized in that said gas recovery means introduces said produced gas into the second half of reduction of said movable hearth type heat treatment furnace.

Said apparatus for manufacturing molten iron is characterized in that said gas recovery means comprises a means for removing dust from the produced gas.

Said apparatus for manufacturing molten iron is characterized in that said gas recovery means comprises a means for cooling the produced gas.

Said apparatus for manufacturing molten iron is characterized in that said gas recovery means comprises a means for regulating the amount of produced gas.

Said apparatus for manufacturing molten iron is characterized in that said movable hearth type heat treatment furnace is a rotary hearth type reduction furnace.

The present invention is a method of operating a movable hearth type heat treatment furnace which discharges heat-treated products from the movable hearth type heat treatment furnace to a downstream side facility, characterized in that the method comprises steps of: receiving and temporarily retaining the heat-treated products discharged from said movable hearth type heat treatment furnace in a receiving recess of a recessed retaining member provided in a casing; and reciprocating a scraper along a surface of said receiving recess, so that said heat-treated products retained in said receiving recess are discharged into said casing.

Said method of operating a movable hearth type heat treatment furnace is characterized in that anti-reoxidation gas which at least prevents reoxidation of heat-treated products is blown into said casing.

Said method of operating a movable hearth type heat treatment furnace is characterized in that the heat-treated products discharged from said movable hearth type heat treatment furnace are received in the receiving recess of said recessed retaining member through the internal of said seal leg.

Said method of operating a movable hearth type heat treatment furnace is characterized in that a blowing amount of anti-reoxidation gas blown into said casing is controlled according to a surface temperature of said heat-treated products.

Said method of operating a movable hearth type heat treatment furnace is characterized in that discharge amount of the heat-treated products is controlled by regulating the reciprocation number per hour of said scraper.

The present invention is a method of manufacturing molten iron characterized in that it comprises a reduction step of reducing raw material formed by mixing at least powdered iron oxide-containing material and powdered carbonaceous reducing agent to obtain reduced iron, a sorting step of removing foreign substances entrained in the reduced iron discharged from the reduction step, and a melting step of melting said reduced iron in which said foreign substances have been removed in the sorting step, thereby obtaining molten iron.

Said method of manufacturing molten iron is characterized in that it comprises a feeding step of feeding said reduced iron to said melting step while forming and maintaining the seal portion with said reduced iron in which said foreign substances have been removed in said sorting step.

Said method of manufacturing molten iron is characterized in that said feeding step feeds said reduced iron to said molten iron-manufacturing furnace using said discharge apparatus.

Said method of manufacturing molten iron is characterized in that it comprises a gas recovery step of introducing at least a part of produced gas generated in said reduction step to said reduction step as fuel for reduction.

Said method of manufacturing molten iron is characterized in that said gas recovery step introduces said produced gas at the first half of said reduction step.

Said method of manufacturing molten iron is characterized in that said gas recovery step introduces said produced gas at the second half of said reduction step.

Said method of manufacturing molten iron is characterized in that said gas recovery step comprises a step of removing dust from the produced gas.

Said method of manufacturing molten iron is characterized in that said gas recovery step comprises a step of cooling the produced gas.

Said method of manufacturing molten iron is characterized in that said gas recovery step comprises a step of regulating the amount of produced gas.

Said method of manufacturing molten iron is characterized in that in said reduction step, reduction is performed by a movable hearth type heat treatment furnace.

Said method of manufacturing molten iron is characterized in that said reduction step, reduction is performed by a rotary hearth type heat treatment furnace.

According to the present invention, it is possible to continuously perform a stable operation. Furthermore, because the discharge of heat-treated products is performed by reciprocating the scraper, an intermittent interval is short as compared to a high temperature switching valve and because the heat-treated products can be fed into the melting furnace of downstream side in a condition more close to continuation, continuation of stable operation is possible, whereby the productivity of reduced iron or metallic iron is excellent.

Furthermore, because the possibility that oxidative gas such as the ambient air leaks into the movable hearth type heat treatment furnace is reduced even if the movable hearth type heat treatment furnace is operated under a negative pressure due to the construction that blocks the inflow of air into the movable hearth type heat treatment furnace by the material seal function of the seal leg and the blowing of anti-reoxidation gas in the discharge apparatus, there will be no such problem that reduced iron will be molten and welded or carbonaceous powder will be burnt by heat generated at the oxidation, without reoxidation of reduced iron, whereby it is possible to manufacture products excellent in quality.

And, because the scraper in the form of plate is simple in construction, its contact pressure is low, and its wearing amount is small, an excellent economic effect can be obtained in that maintenance cost can be considerably lowered.

According to the present invention, it is possible to continuously feed reduced iron in the state of high temperature to the melting step (molten iron-manufacturing furnace) while preventing the charge of foreign substances from the reduction step (rotary hearth type reduction furnace) into the molting step (molten iron-manufacturing furnace). By this, it is possible to continuously manufacture molten iron of stable quality in low cost without stopping the operation.

And, in addition to the above effects, it is possible to continuously feed reduced iron to the melting step (molten iron-manufacturing furnace) while preventing reoxidation of reduced iron without causing inflow of the ambient air into the reduction step (rotary hearth type reduction furnace) even if the ambient air leaks into the melting step (molten iron-manufacturing furnace).

Moreover, produced gas generated in the melting step (molten iron-manufacturing furnace) can be efficiently used as reducing fuel of the reduction step (rotary hearth type reduction furnace).

According to the present invention, the problem of reoxidation of reduced iron is not caused even if a little ambient air is entrained in the produced gas generated in the melting step (molten iron-manufacturing furnace).

Also, it is possible to use the produced gas generated in the melting step (molten iron-manufacturing furnace) and containing dust, as fuel gas, after purifying it.

Furthermore, it is not required to make a facility following the produced gas-cooling step (produced gas-cooling means) to a specification of high temperature and is possible to make it compact.

According to the present invention, it is possible to use the produced gas generated in the melting step (molten iron-manufacturing furnace) as reducing fuel for the reduction step (rotary hearth type reduction furnace) without influencing the operation of reduction step (rotary hearth type reduction furnace) even if its amount is fluctuated.

DESCRIPTION OF THE PREFERRED EMBODIMENTS

At first, a discharge apparatus for a movable hearth type reduction furnace as a movable hearth type heat treatment furnace related to an embodiment for carrying out the operating method of the movable hearth type heat treatment furnace of the present invention will be described sequentially with reference to FIG. 1 which is a perspective view diagrammatically showing the whole of the discharge apparatus, FIG. 2 which is a longitudinal cross-sectional view diagrammatically showing a casing having a hopper attached thereto, and FIG. 3 which is an explanatory view showing the operation of its scraper.

Figure 1:
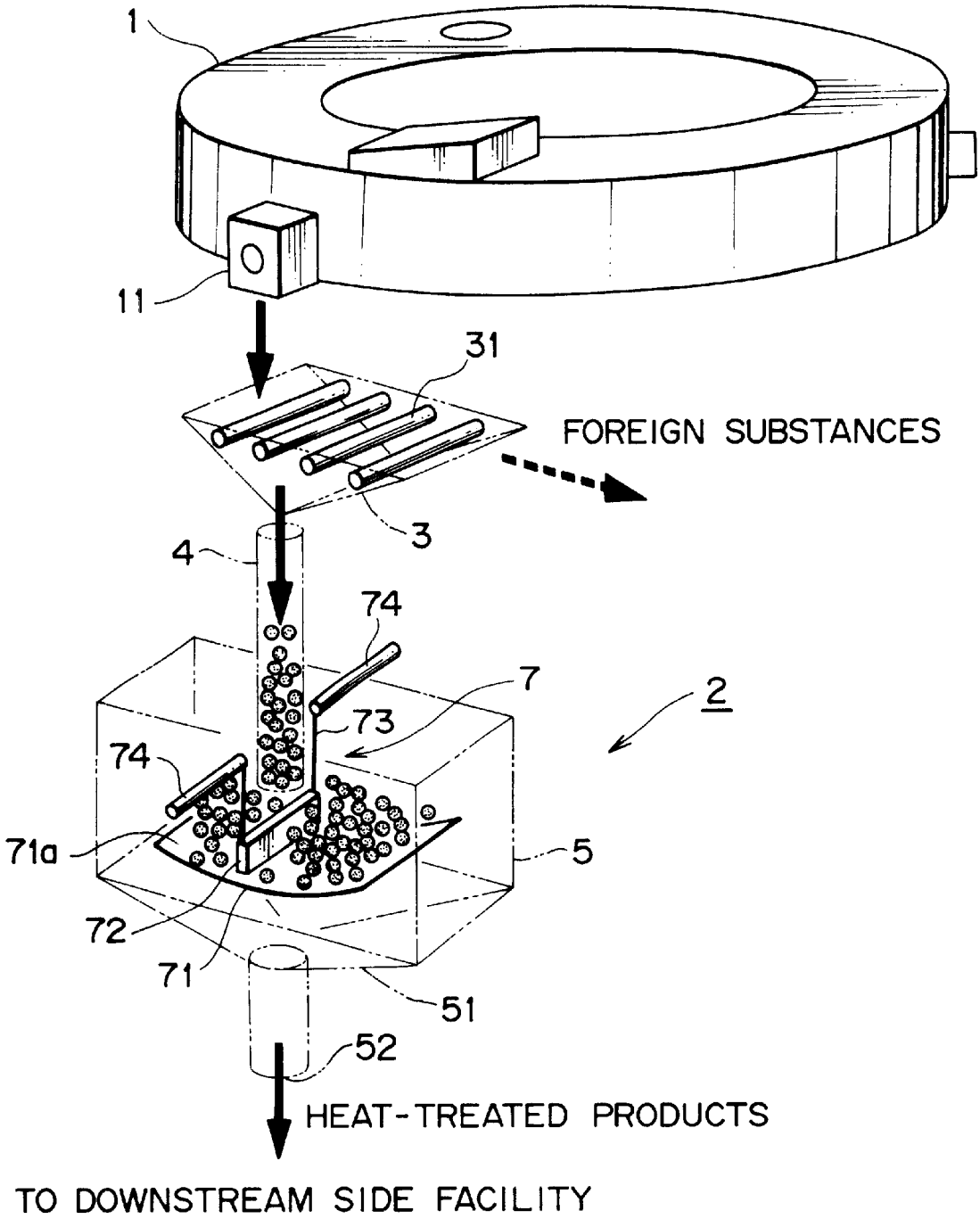
FIG. 1 is a perspective view diagrammatically showing the whole of a discharge apparatus related to an embodiment for carrying out an operating method of a movable hearth type reduction furnace according to the present invention.

In FIG. 1, reference numeral 1 indicates a movable hearth type heat treatment furnace including a circular hearth that is not shown and rotates about a vertical axle center as a rotating center. Herein, because the reduction is performed by heat treatment, the description will be made as to the movable hearth type reduction furnace. The movable hearth type reduction furnace 1 is provided in its outer peripheral side with a discharge port 11 for discharging raw material, which was thrown into the hearth by a throw-in apparatus which is not shown and heat-treated while the hearth rotates one revolution about the vertical axle center as the rotating center, i.e., for discharging reduced heat-treated products (either reduced iron which is highly reoxidizable or metallic iron which has no reoxidation problem) or carbonaceous powder and slag mixture, so that the heat-treated products are discharged from the discharge port 11 into a discharge apparatus 2 having a construction to be explained herein below. In addition, although it is not shown from the discharge port 11 to the discharge apparatus 2 is communicated with a cylindrical discharge chute, which can be gastightly sealed. Such a furnace is generally called as a rotary hearth furnace or rotary hearth type reduction furnace.

The discharge apparatus 2 is provided with a plurality of rotating rollers 31 which are disposed in parallel and discharges various foreign substances, for example refractory material, conglomerations formed by pellets adhered together, peeled-off hearth material, foreign substances introduced when charging raw material, and the like from the heat-treated products discharged from the discharge port 11 out of the system, and a sorting means 3, for example, a roller screen called as a screen sizer (herein below, to be referred as 'screen sizer 3') which is housed in a gastight casing not shown. A seal leg 4 which is a charge chute downwardly guides heat-treated products in which foreign substances were removed by the screen sizer 3 and which has a function of material seal is provided, in which the lower end of seal leg 4 is provided with a plurality of gas blowing nozzles 76 (two in this embodiment) for blowing anti-reoxidation gas such as inert gas, for example, nitrogen gas and the like or exhaust gas which does not contain oxidative gas in order to prevent the reoxidation of reduced iron which is highly reoxidizable (see FIG. 2), and a quantitative discharge apparatus 7 having a construction and function to be explained hereinafter, and the low end of seal leg gastightly passes through the casing 5 having a hopper attached thereto, the bottom side of which a hopper part 51 is attached to.

In addition, although the shape of the seal leg 4 is cylindrical, it is not limited to this shape if the material seal function is provided, and may be, for example, a prismatic shape. Also, although the gas blowing nozzles 76 are communicated to a part of the seal leg 4 projected into the casing 5 having a hopper attached thereto, as shown in FIG. 2, it is not limited to this construction and the seal leg 4 may be in the outside of the casing 5 having a hopper attached thereto. That is, the position that the blowing gas nozzles 76 are communicated to the seal leg 4 is preferably determined considering the capability of maintaining the internal pressure of the movable hearth type reduction furnace 1.

Figure 2:
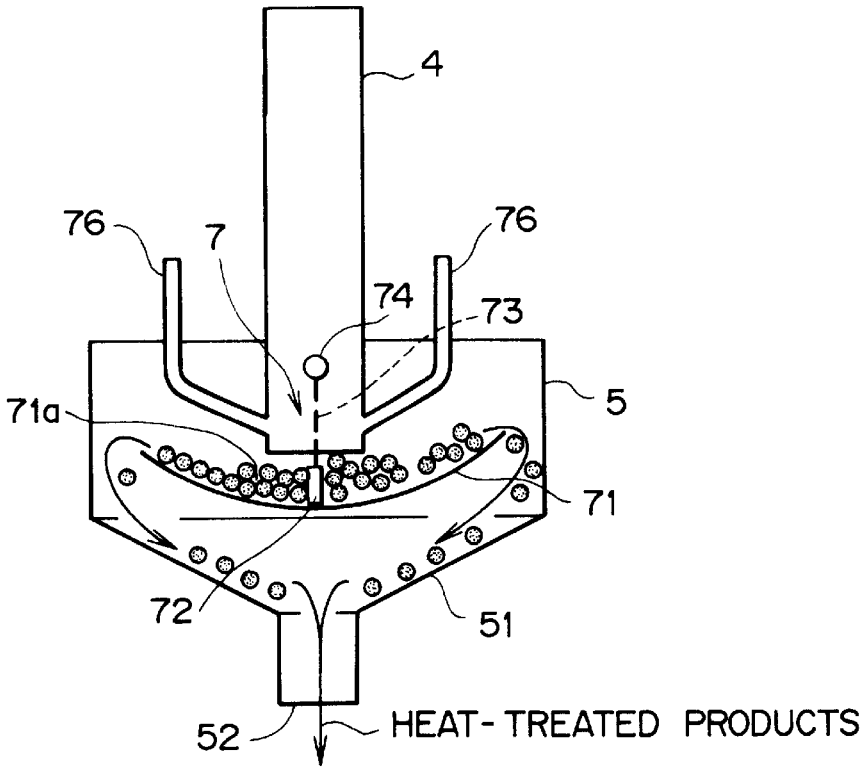
FIG. 2 is a longitudinal cross-sectional view diagrammatically showing a casing having a hopper of the discharge apparatus for the movable hearth type reduction furnace attached thereto related to an embodiment for carrying out the present invention.
Figure 3:
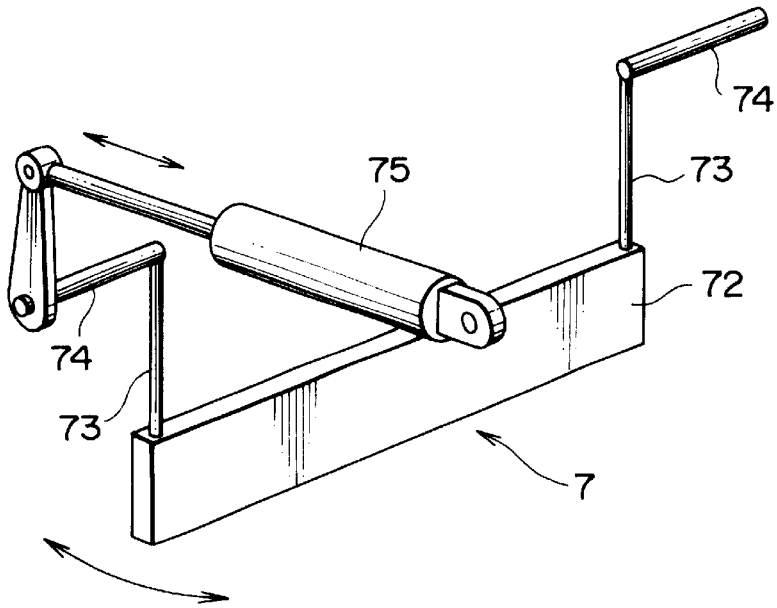
FIG. 3 is an explanatory view showing the operation of the scraper of discharge apparatus for the movable hearth type reduction furnace related to an embodiment for carrying out the present invention.

The quantitative discharge apparatus 7 is constructed as shown in FIGS. 1 to 3. That is, it comprises a receiving pan 71 as a recessed retaining member which is formed by curving a flat plate so that a receiving recess 71*a* is formed on its upper side, and which receives and temporarily retains heat-treated products discharged from the seal leg 4. A scraper 72 in the form of transversely extended flat plate is also provided, which has a function of discharging heat-treated products received in the receiving pan 71 out of both sides thereof by being reciprocated, i.e., swung along the curved surface of the receiving pan 71.

A lower end of a swing arm 73 is fixed to each end of the scraper 72, the upper end of the swing arm being fixed in a pivot shaft 74 which passes through an end face of the casing 5 having a hopper attached thereto, and the pivot shaft 74 is constructed to be swung by extending and retracting movements of a rod of a pivot shaft-actuating cylinder 75. Of course, the widthwise ends of the receiving pan 71 are fixed to internal walls of the casing 5 having a hopper attached thereto or two parallel and vertical wall plates, so that heat-treated products shall not overflow and drop in the widthwise of the receiving pan 71.

In addition, the pivot shaft-actuating cylinder 75 may be driven by any driving source such as hydraulic pressure, pneumatic pressure, electric driving and the like. Furthermore, because it is possible to obtain a function equal to that of the pivot shaft-actuating cylinder 75 if a pinion is mounted around a front end of the pivot shaft 74 and a rack to be engaged with the pinion is attached to a front end of the rod of the pivot shaftactuating cylinder 75 so that the scraper 72 is swung by reciprocating the rack to render swivel movements to the pivot shaft 74, the present invention is not limited to the swing construction.

Because the scraper 72 has a function of discharging heat-treated products out of the both sides of the receiving pan, and because it is possible to discharge even largely conglomerated heat-treated products by the discharge apparatus 2 only, without any problem if heat-treated products or foreign substances are sized to have a dimension in a range to be passed through the seal leg 4, it is not essential to provide the screen sizer 3. However, especially if largely conglomerated heat-treated products are discharged in a high frequency from the discharge port 11, it is possible to remove largely conglomerated heat-treated products by setting the screen sizer 3, thereby obtaining an effect that the scraper 72 can be smoothly operated.

And, the construction is made so that heat-treated products discharged in a fixed amount from the lower discharge port 52 of the hopper part 51 of the casing 5 having a hopper attached thereto will be sent to a downstream side facility not shown. Meanwhile, because it is possible to render heat-treated products to be dwelled in the receiving pan 71, the seal leg 4 or the hopper part 51 by stopping the swing movements of the scraper 72, a buffering function can be obtained to a certain degree, for example, even if the downstream side facility or the movable hearth type reduction furnace in the upstream side were emergently stopped.

Herein below, the working mode of the discharge apparatus 2 for the movable hearth type reduction furnace 1 constructed as explained in the above will be explained; when heat-treated products subjected to heat treatment on the hearth is discharged from the discharge port 11, firstly anti-reoxidation gas, for example inert gas such as nitrogen gas or exhaust gas which does not contain oxidative gas is blown into the casing 5 having a hopper attached thereto from gas blowing nozzles 76 in order to prevent outflow of hot gas from the movable hearth type reduction furnace 1 and to prevent the reoxidation of heat-treated products and simultaneously the discharge of heat-treated products from the discharge port is started. The amount of anti-reoxidation gas to be blown into the casing is controlled to increase and decrease according to the fluctuation of temperature of heat-treated products; if the temperature of heat-treated products is high, a large amount of anti-reoxidation gas is blown into the casing, whereas if the temperature of heat-treated products is low, a small amount of anti-oxidation gas is blown into the casing.

Heat-treated products discharged from the discharge port 11 are subjected removal of largely conglomerated foreign substances by the screen sizer 3, and only heat-treated products having a grain diameter not larger than a predetermined value are moved into the cylindrical seal leg 4 filled with anti-reoxidation gas, descend within the seal leg 4 while preventing an outflow of gas from the movable hearth type reduction furnace 1 and an inflow of downstream gas containing oxidative gas such as ambient air by a material seal function, drop onto the top surface of the receiving recess 71*a* of the receiving pan 71 in the casing 5 having a hopper attached thereto, and are deposited and temporarily retained on the top surface of the receiving recess 71*a* according to angle of repose.

In this embodiment, although anti-oxidation gas such as inert gas, for example nitrogen gas and the like, and exhaust gas which does not contain an oxidative gas is blown from the gas blowing nozzles 76, if heat-treated products are reduced iron and the like which are highly reoxidizable, as explained in the above, it is possible to use a gas of hydrocarbon class which is reductive gas, for example, natural gas may be blown, instead of inert gas such as nitrogen gas and exhaust gas which does not contain oxidative gas. By blowing-in natural gas from the gas blowing nozzles 76, it is possible to obtain some effects: it is possible to prevent lowering of metallization rate due to the reoxidation of reduced iron of high temperature among heat-treated products within the casing 5 having a hopper attached thereto as well as to control the surface temperature of reduced iron or metallic iron with a simple and self-controlled process because a decomposition reaction which is an endothermic reaction is promoted as the temperature of reduced iron or metallic iron is elevated; and it is also possible to efficiently prevent adhesion among reduced iron or metallic iron because carbon is produced adjacent to the surface of reduced iron or metallic iron by the decomposition reaction.

Moreover, when heat-treated products having an extraordinarily high temperature are discharged from the movable hearth type reduction furnace 1, it is possible to prevent the reoxidation of heat-treated products by controlling the blowing amount of anti-reoxidation gas from the gas blowing nozzles 76 and urgently cooling it according to the fluctuation of surface temperature of heat-treated products deposited on the top surface of the receiving recess 71*a* of the receiving pan 71, or surface temperature of the iron shells of the screen sizer 3, the seal leg 4, scraper 72, the chute connecting them or the like.

Furthermore, when heat-treated products having an extraordinarily high temperature are discharged from the movable hearth type reduction furnace 1 or heat-treated products having a high temperature are dwelled in the discharge apparatus 2 for a long time, it is possible to prevent adhesion among reduced iron or metallic iron, which is a heat-treated product by feeding powdered carbonaceous material or lime class material to the screen sizer 3, seal leg 4, scraper 72 and the like in addition to cooling of heat-treated products and prevention of reoxidation due to blowing in the anti-reoxidation gas as explained in the above.

Next, heat-treated products temporarily retained on the receiving pan 71 are discharged into the casing 5 having a hopper attached thereto from the longitudinal ends of the receiving pan 71 by controlling the swivel speed of the scraper 72. In that case, the swivel speed of the scraper 72 may be controlled either depending on a deposited level of heat-treated products on the top surface of the receiving recess 71*a* of the receiving pan 71, or depending on a deposited weight or its variation. The heat-treated products discharged into the casing 5 having a hopper attached thereto in this manner slide or fall down the hopper part 51 of casing 5 having a hopper attached thereto and are fed from the discharge port 52 of bottom side to a downstream side facility and subjected to proper processing in the downstream side facility.

In addition, although there is no special limit to a method of measuring the deposited level of heat-treated products in the top surface of the receiving recess 71*a* of the receiving pan 71, it is preferred to measure the deposited level of heat-treated products in a non-contact type. For example, it can be considered to provide a gamma ray level meter of non-contact type on the external wall surface of the seal leg 4 and casing 5 having a hopper attached thereto. It can be also considered to employ a load cell, microwave, capacitance measurement system and the like.

As described in detail in the above, according to the discharge apparatus 2 for the movable hearth type reduction furnace 1 related to this embodiment, the receiving pan 71 and the scraper 72 have very simple constructions and thus can be made using only a high-temperature resistance material. Also, it is possible to cope with a temperature condition of reduced iron, carbonaceous powder and slag mixture which are discharged, by forming the receiving pan 71, scraper 72 or rotating rollers 31 of screen sizer 3 to have a water cooling construction of the double prismatic shape, thereby improving the heat resistance. In addition, as can be well understood from FIGS. 1 and 2, the pivot shaft 74 and a driving part, which is not shown, will not contact with heat-treated products.

Therefore, because the discharge apparatus 2 for the movable hearth type reduction furnace 1 related to this embodiment does not include a high temperature switching valve in contrast to the prior art examples 1 and 2, troubles are occurred so little that it is possible to perform continuous operation. In addition, because it is constructed to discharge by the swivel movements of scraper 72 rather than by the high temperature switching valve, it is possible to continuously discharge heat-treated products, thereby contributing the improvement in productivity of iron products greatly because reduced iron or metallic iron can be continuously molten even if a melting furnace is installed in the downstream side.

Moreover, the discharge apparatus 2 for the movable hearth type reduction furnace 1 related to this embodiment can block inflow of oxidative gas, such as the ambient air, into the movable hearth type reduction furnace 1 by the material seal function in the seal leg 4 and anti-reoxidation gas, in contrast to the movable hearth type reduction furnace related to the prior art examples 2 and 3, and because the possibility that oxidative gas leaks into the movable hearth type reduction furnace 1 is very low even if the movable hearth type reduction furnace is operated under a negative pressure, it is possible to reduces the problem such as deterioration in product value by oxidation of reduced iron and other problems caused by either welding of reduced iron due to melting of reduced iron or combustion of carbonaceous powder by heat generated at the oxidation.

Although there were problems as to high-temperature resistance and gas tightness in the vibration feeder, screw conveyer, pan conveyer and the like in the discharge apparatus for movable hearth type reduction furnace related to the prior art example 3, the discharge apparatus 2 for the movable hearth type reduction furnace 1 related to this embodiment does not have such a problem that the pivot shaft 74 contacts with heat-treated products during the discharge of heat-treated products, besides the fact that heat resistance is improved by forming the receiving pan 71, scraper 72 or rotating rollers 31 of screen sizer 3 to have a water cooling means of the double prismatic shape, as described in the above, so that it is possible to cope with temperature condition of discharged heat-treated products by improving heat resistance.

Furthermore, although the scraper 72 directly contacts with heat-treated products similar to the screw shaft of screw conveyer in the discharge apparatus related to the prior art example 3, because its construction of plate shape is much simple as compared to the screw shaft, its contact pressure is low, and its wearing amount is small so that the problem of heat resistance or exhaustion of abrasion is small, whereby an excellent economic effect can be obtained in that maintenance cost can be considerably lowered.

In addition, the movable hearth type reducing hearth 1 that discharges reduced iron which is highly reoxidizable or metallic iron which has no problem of reoxidation, carbonaceous powder, slag mixture, and the like as a heat-treated product is explained in the above as an example. However, because the technical idea of the present invention is applicable to discharge of heat-treated metallic iron material containing metallic iron that is not so reoxidizable or metallic iron or non iron metal that substantially has no problem of reoxidation as well as to discharge reduced iron which is highly reoxidizable, the scope to which the present invention is applicable is not limited to the above embodiment and a change of design can be freely made without departing from the technical idea of the present invention.

Herein below, embodiments of the present invention will be explained using schematic views of construction of facilities and process flows for carrying out the method of manufacturing molten iron (apparatus for manufacturing molten iron) related to the present invention shown in FIGS. 4 to 6.

(1) Firstly, in the 'reduction step,' raw material formed by mixing at least powdered iron oxide-containing material and powdered carbonaceous reducing agent is charged into a reduction furnace to obtain reduced iron. Although there is no special limit to the type of reduction furnace used in the reduction step, a movable hearth type heat treatment furnace, for example, a rotary hearth type reduction furnace is recommended in view of facility cost, workability and the like.

Here, it is possible to use iron ore, blast furnace dust, steel-making dust, electric furnace dust, mill scale and the like as iron oxide-containing material, and to use coal, coke, oil coke and the like as carbonaceous reducing agent (herein below, sometimes referred to as coal material). These materials are crushed to about −0.1 mm in a powdered form as needed, mixed and then charged as raw material into the rotary hearth furnace 1 shown in FIG. 5 or 6, which is a rotary hearth type reduction furnace, as it is or after formed into small masses, pellets, briquette shapes, plate-shaped conglomerations and the like. In addition, a binder such as bentonite, starch, hydrated lime, organic binder and the like may be added when forming, as needed. In order to ease the melting of reduced iron in a smelting furnace 8 which is a molten iron-manufacturing furnace, a flux such as quicklime, dolomite, serpentinite and the like may also be added. If water is added when forming the raw material, the formed raw material may be charged into the rotary hearth furnace 1 after dried at a temperature not more than 200° C., at which carbonaceous reducing agent does not fire.

The raw material is fed into the rotary hearth furnace 1 using an appropriate charge apparatus. The raw material is heated to about 1200–1500° C. by radiant heat of combustion gas from a burner provided on the upper side within the furnace as the hearth rotates, during which the raw material is reduced directly and indirectly by coal material to a desired reduction ratio to be reduced iron. The reduced iron is cooled to about 1000° C. by blowing off reducing gas, hydrocarbon-containing gas, inert gas such as nitrogen and the like in the furnace or providing a water-cooling plate directly above it to indirectly cool it, and discharged out of the furnace.

(2) Next, in the 'sorting step,' foreign substances entrained in reduced iron discharged from the reduction step are screened and removed by the sorting apparatus.

Figure 4:
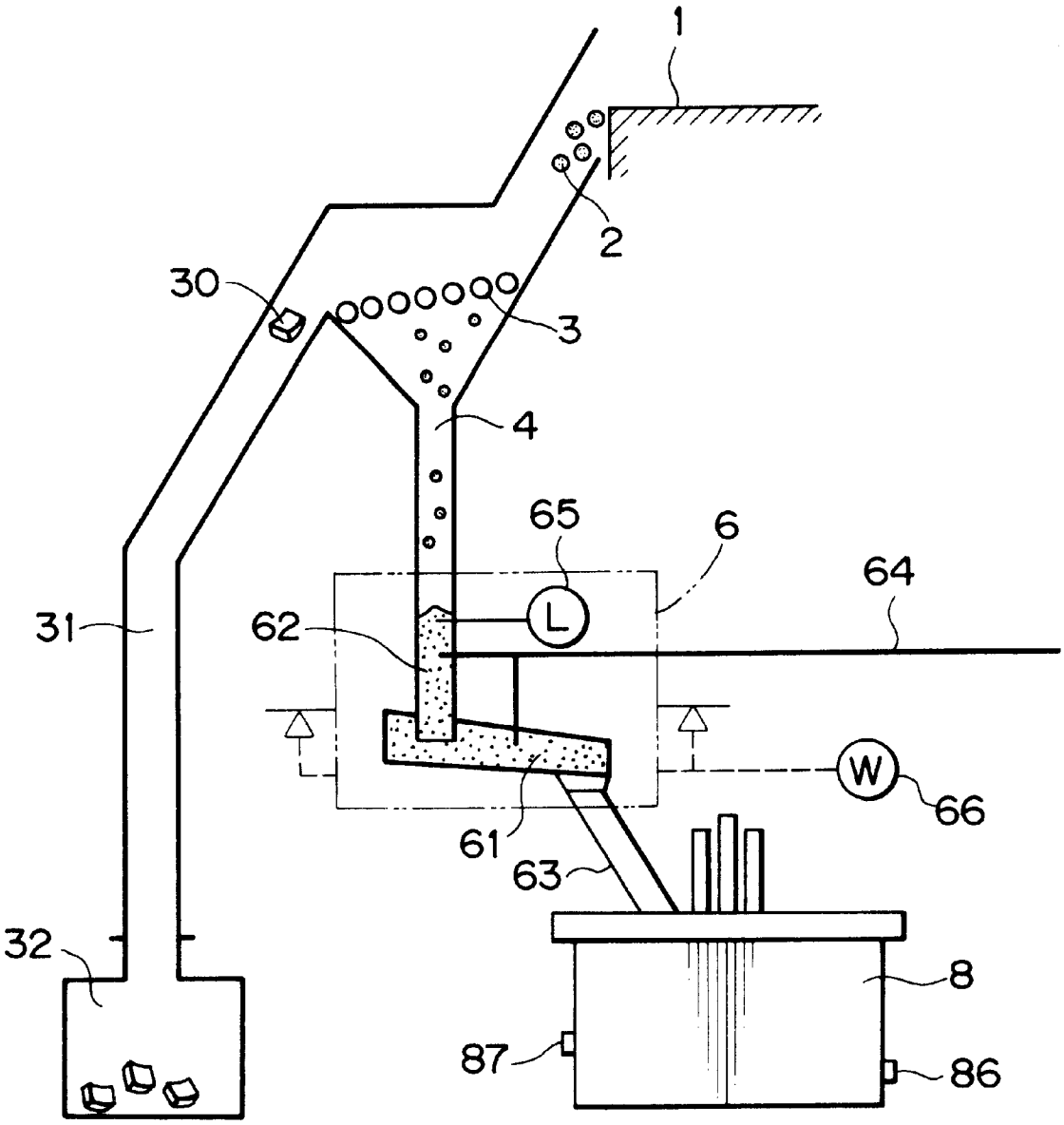
FIG. 4 is a schematic view showing an example of facility construction of sorting step (sorting means) and feeding step (feeding means) of a method of manufacturing molten iron (apparatus for manufacturing molten iron) related to the present invention.

As shown in FIG. 4, reduced iron 10 discharged from the rotary hearth furnace 1 is firstly screened by a sorting apparatus 3 which is a sorting means, so that those on the screen, which have a size larger than a predetermined grain diameter (for example, 50 mm), will be removed to out of the system as foreign substances 30, whereas those located below the screen, which are passed through the sorting means, will be fed into the smelting furnace 8 as reduced iron. As the sorting apparatus 3, for example, a fixed type grizzly, water cooled roller screen (screen sizer) is may be used because it deals with solids of high temperature of about 1000° C. It is preferred if the roller screen is used, because it is possible to appropriately perform regulation of sorting of grain diameter by changing the distance between axles. Foreign substances (oversize) 30 sorted by the sorting apparatus 3 are passed through the chute 31 for discharging foreign substances and captured by a sealed container 32 connected to a front end of the chute 31 while preventing ingress of ambient air into the inside of the system. In addition, a double damper may be used instead of the sealed container 32 for keeping air tightness and discharging foreign substances out of the system.

Because foreign substances of large grain size are removed by the sorting apparatus 3 and only the reduced iron 10 having a diameter smaller than a predetermined grain size is passed into the charge shaft (seal leg) 4, blockage is not occurred in the charge shaft even if its internal diameter is not so large and the reduced iron 10 can be continuously fed into the smelting furnace 8. Also, blockage due to foreign substances is not occurred in a molten pig iron tapping port 86 and residue discharge port 87, and even if a smelting furnace 8 provided with electrodes such as submerged arc furnace is used as the smelting furnace, neither the damage of electrodes nor deterioration of productivity due to disturbance of electricity flow is occurred.

In addition, if there are foreign substances smaller than reduced iron in diameter, such as powdered carbonaceous material used for protecting the surface of hearth or regulating the atmosphere within the furnace, powdered refractory material, powdered raw material, slag produced by melting of powdered material or raw material and the like, it is desired to sort and remove them using a sorting means identical to that explained in the above, a sieve shaker, a wind force sorter or the like.

(3) Next, in the 'feeding step,' a seal part such as material seal is formed with reduced iron that foreign substances were removed in the sorting step, and reduced iron is quantitatively fed to the melting step by a quantitative feeding apparatus while maintaining the seal part.

The reduced iron 10 is charged into the charge chute 4 to a predetermined level, and then a material seal 62 is preferably formed as the seal part while preventing the reoxidation of reduced iron by feeding a small amount of reducing gas or inert gas such as nitrogen into the charged layer as seal gas. By the material seal 62, inflow of gas from the smelting furnace 8 to the rotary hearth furnace 1 substantially does not exist. Therefore, because the ambient air can not ingress into the rotary hearth furnace 1 even if it air leaks into the smelting furnace, for example, when residues are discharged, the possibility that the reduced iron is reoxidized does not exist. In addition, it is preferred to regulate the charged level of reduced iron in the material seal 62, flow rate of seal gas and the like according to the difference between atmospheric pressures of rotary hearth 1 and smelting furnace 8.

As shown in FIG. 4, it is more preferred to provide a quantitative feeding apparatus 61, which is a feeding means for quantitatively cutting out reduced iron, at the lower end of the material seal 62. By this, it is possible to feed the reduced iron 10 to the smelting furnace 8 in a substantially constant amount while maintaining the material seal 62, even if the amount of reduced iron 2 discharged from the rotary hearth furnace 1 fluctuates. For example, by using a cutting-off apparatus such as a vibration feeder, screw feeder, and pusher as the quantitative feeding apparatus 61 and respectively regulating the numbers of vibrations and revolutions, the cutting-off amount is substantially constantly maintained. Also, it is preferred to provide a level meter 65 for measuring the position of top surface of charged layer of reduced iron in the material seal 62 and to reduce or increase the cutting-off amount of reduced iron by the quantitative feeding apparatus 61 only when the position of top surface of reduced iron layer measured by the level meter is out of predetermined upper or lower limit of height, so that the position of top surface of reduced iron layer can be controlled to be returned to the range between the predetermined upper and lower limits of height. By this, it is possible to quantitatively feed reduced iron into the smelting furnace 8 while maintaining the above-mentioned function of material seal 62 (function for preventing inflow of ambient air into the rotary hearth furnace). Here, the predetermined upper limit of height means the upper limit of height that the charged layer of reduced iron having a high temperature in the material seal 62 will not be adhered by its own weight, the predetermined lower limit of height means the lower limit of height that the above-mentioned function of material seal 62 (function for preventing inflow of ambient air into the rotary hearth furnace) can be maintained, and it is desired to determine them in advance through an experiment. Instead of using the level meter 65, it may be also possible to continuously measure, for example, the weight of parts of material seal 62 and quantitative feeding apparatus 61 (the portion surrounded by the phantom line in FIG. 4) and to regulate the cutting-off amount of the reduced iron 10 to be as constant as possible. In this case, it is preferred to connect the connection part between the material seal 62 and sorting apparatus 3 and the connection part between the quantitative feeding apparatus 61 and feeding chute 63 for the smelting furnace using flexible joints, so that the measured weight is not influenced by reactive force from the sorting apparatus 3 or feeding chute 63 for the smelting furnace.

In addition, the material seal 62 may be constructed as the quantitative discharge apparatus 7 and it is preferred to construct the material seal 62 and quantitative feeding apparatus 61 as the above-mentioned quantitative discharge apparatus, because both of their functions can be achieved.

(4) Next, in the 'melting step,' molten iron is obtained by reducing and melting the reduced iron quantitatively fed from the feeding step, in the smelting furnace.

The smelting furnace 8 may be any type of furnace if it can reduce and melt the reduced iron 10 to obtain molten iron, and the energy used therein is not limited to a certain type; it may use any of coal, coke, electricity, gas, plasma and the like and it may be any of well-known smelting furnaces, a shaft smelting furnace such as a blast furnace, and a melting reduction furnace. However, the smelting furnace 8 is charged with carbonaceous reducing agent (coal material) or slag-forming material besides the reduced iron as needed, in accordance with the type of employed smelting furnace or the used composition or mixture of raw material. The reduced iron charged into the smelting furnace 8 is heated to about 1400–1550° C. in the smelting furnace 8, unreduced FeO in the reduced iron 10 is reduced by residual carbon in the reduced iron 10, coal material charged into the smelting furnace, carbon solid-solved in molten pig iron retained in the smelting furnace 8 and the like in accordance with a reduction reaction expressed by a formulae: $FeO+C \rightarrow Fe+CO$, so that metallic component in the reduced iron 10 will be almost completely metallized, carbonized to have a lowered melting point by being heated, or molten into molten pig iron. Meanwhile, gangue component in the reduced iron 10 reacts with slag forming materials added in raw material or charged in the smelting furnace 8, so that its melting point will be lowered, and it will be molten into slag and separated from the molten pig iron.

The produced molten pig iron and slag are discharged out of furnace from the molten pig iron tapping port 86 and residue discharge port 87 provided in the bottom portion of smelting furnace 8 in every predetermined time, whereby molten pig iron can be manufactured without stopping the operations of rotary hearth furnace 1 and smelting furnace 8.

(5) In the 'gas recovery step, at least a part of produced gas generated in the melting step is introduced to the reduction step as reducing fuel.

The amount of CO gas generated as byproduct by the reduction reaction of unreduced FeO among the reduced iron 10 in the smelting furnace 8 as explained in the above may be varied depending on the content of FeO in the reduced iron (i.e., metallization rate) and will be 40–90 $Nm^3$ per pig iron, 1 ton when metallization rate is 80–90%, and the temperature of gas discharged from the smelting furnace 8 may be varied in accordance with the type of employed smelting furnace 8 and will be in the range of 100–1600° C. The combustion caloric value of CO gas is about 12.6 $MJ/Nm^3$; therefore, if produced gas generated in the smelting furnace is used in the rotary hearth furnace 1 as reducing fuel, it is possible to cut down about 0.5–1.1 GJ per pig iron, 1 ton on the reduction caloric value (which is varied depending on the heat loss in the furnace wall of rotary hearth furnace and is typically about 2–3 GJ per pig iron, 1 ton) needed in the rotary hearth furnace 1. In addition, the smelting furnace 8 which is a type using gas produced by burning coal material with oxygen-containing gas as its heat source of the smelting furnace 8 may generate more amount of CO gas that explained above and thus cut-down amount in the rotary hearth furnace 1 may be increased.

In addition, in the 'gas recovery step,' it is desired to perform 'step of removing dust from the produced gas' for removing dust from produced gas generated in the melting step using a cyclone, high temperature bag filter and the like, 'step of cooling the produced gas' for cooling the produced gas using a heat exchanger, water-cooling apparatus and the like, and 'step for regulating the amount of produced gas' for equalizing the amount of gas fed into the reduction step using a damping tank, accumulator and the like. It is also preferred to simultaneously perform the dust removal and cooling of produced gas using a scrubber, so that a cross between the 'step of removing dust from the produced gas' and the 'step of cooling the produced gas' can be made.

Figure 5:
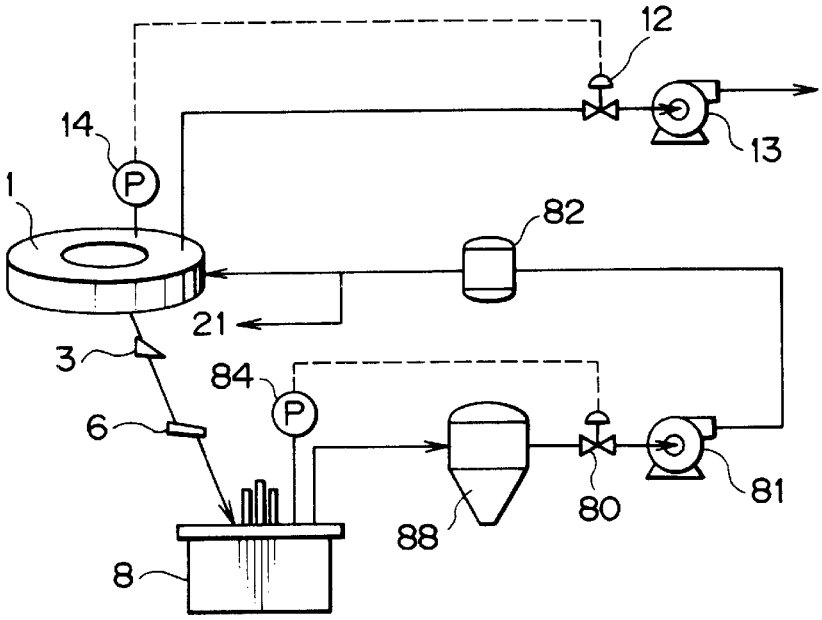
FIG. 5 is a view showing one mode for carrying out the method of manufacturing molten iron (apparatus for manufacturing molten iron)
Figure 6:
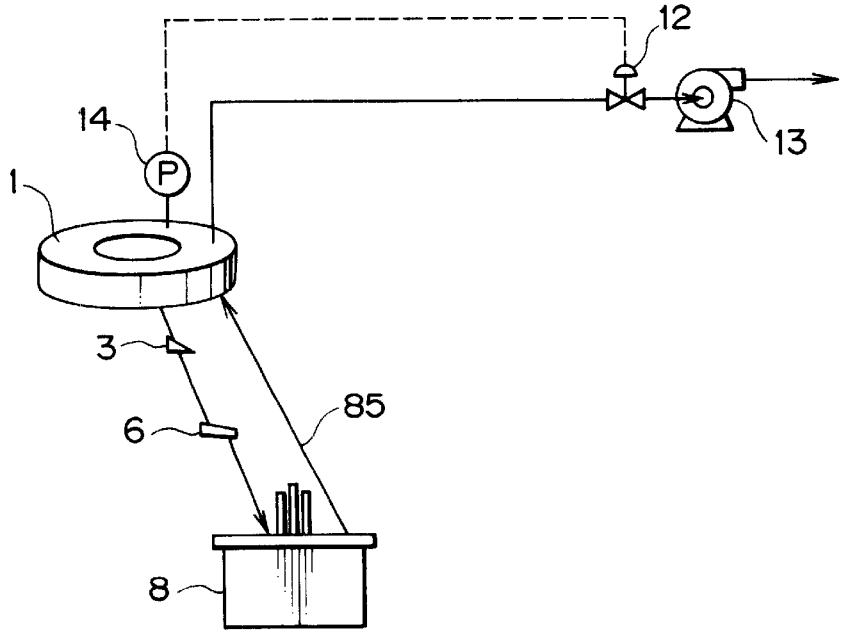
FIG. 6 is a view showing another mode for carrying out the method of manufacturing molten iron (apparatus for manufacturing molten iron).

FIG. 5 shows one of preferred modes for using produced gas of smelting furnace in the rotary hearth furnace 1. The produced gas of smelting furnace is firstly dust-removed and cooled by a scrubber 88 which is the dust removal and cooling means. By this, although sensible heat of gas is lost, there are advantages in that the facilities located thereafter is not required to be made in a high temperature specification and they can be made to be compact because true volume of gas is small. The produced gas of smelting furnace is drawn in from the smelting furnace 8 so that atmospheric pressure in the smelting is to be substantially constant, by regulating the opening size of control valve 80 for controlling the produced gas of smelting furnace and the amount of produced gas of smelting furnace sucked in by a suction fan 81 based on a signal from a pressure gauge 84 of smelting furnace. Although the amount of produced gas of smelting furnace is constant unless the operational condition is changed, it is varied if the amount of reduced iron 10 fed into the smelting furnace 8 from the rotary hearth furnace 1 or metallization rate is changed, or if an abnormal operation such as tapping of pig iron, discharging of residues and the like is performed. Due to that, it is desired to provide a damping tank 82 as a means for regulating the amount of produced gas, so that a constant amount of produced gas of smelting furnace can be always fed into the rotary hearth furnace 1 even if such a variation is occurred. The internal volume of damping tank 82 is sufficient unless variation is occurred in the gas amount fed into the rotary hearth furnace 1, and is preferably determined in accordance with types of operations (e.g., types of tapping of pig iron and discharging of residues). In addition, although the amount of produced gas of smelting furnace 1 may exceed reducing caloric value required in the rotary hearth furnace 1 in accordance with the type of employed smelting furnace 8, in that case, it is preferred to use excessive gas as fuel gas in the step for drying raw material in advance, coal material crushing step, conglomeration drying step, and the other subsidiary facilities. Although it is possible to prevent inflow of gas into the rotary hearth furnace 1 from the smelting furnace 8 by the material seal 62 as explained in the above, as its premise, it is required to keep the atmospheric pressure of rotary hearth furnace 1 as constant as possible even if the amount of exhaust gas from the rotary hearth furnace 1 is varied. For this, for example, it is preferred to provide a pressure gauge 14 for measuring the atmospheric pressure of rotary hearth furnace 1, and to regulate the opening size of control valve 12 for controlling exhaust gas of rotary hearth furnace and the amount of gas sucked in by an exhaust gas suction fan 13 based on the signal from the pressure gauge 14, so that the atmospheric pressure of rotary hearth furnace 1 can be controlled to be constant.

In addition, as the means for removing dust, it is preferred to appropriately use a cyclone, high temperature bag filter and the like. And, a heat exchanger, water-cooling apparatus and the like may be used as the cooling means. Also, an accumulator and the like may be used as the means for regulating the amount of produced gas.

FIG. 3 shows another preferred mode for using produced gas of smelting furnace in the rotary hearth furnace 1. The produced gas of smelting furnace is introduced into the first half of rotary hearth furnace 1 by a duct 85 for produced gas of smelting furnace while it is in a high temperature, without being dust-removed and cooled. By introducing the produced gas of smelting furnace into the rotary hearth while it is in a high temperature, facilities can be drastically simplified besides efficiently using sensible heat of gas, because the cooling step of produced gas of smelting furnace is excluded as shown in FIG. 5. In addition, because the produced gas of smelting furnace, which has a high temperature of 1000–1600° C., is additionally burnt, it is preferred to keep the combustion air in excess or to reduce the combustion air to cause imperfect combustion, so that the atmospheric temperature within the rotary hearth furnace will not rise so high. Also, because the rotary hearth furnace 1 and smelting furnace 8 automatically become an equal pressure by the duct 85 for produced gas of smelting furnace, it is possible to take a pressure balance throughout the system by controlling the atmospheric pressure of rotary hearth furnace only, without requiring individual pressure control as shown in FIG. 5. The reason why it is preferred to introduce the produced gas of smelting furnace in the first half of rotary hearth furnace 1 is because in the first half of rotary hearth furnace 1, the reduction from raw material to reduced iron is in its way and thus it is not required to mind the reoxidation of reduced iron and there will be no problem even if a little ambient air is entrained in the produced gas of smelting furnace to be introduced.

In addition, if the ambient air leaking from the outside into the smelting furnace 8, rotary hearth furnace 1 and duct 85 for produced gas of smelting furnace is small, the produced gas of smelting furnace may be introduced into the second half of rotary hearth furnace, because the reoxidation of reduced iron is not occurred.

In view of securing seal property and preventing deposition of molten adhesion material from the smelting furnace, it is also preferred to make the connection part between the duct 85 for produced gas of smelting furnace and each furnace (smelting furnace 8 and rotary hearth furnace 1) and the duct 85 for produced gas of smelting furnace in a water-cooling construction.

Furthermore, when coal containing much volatile component is used as coal material, there may be a problem in that extravagant caloric value is reciprocated and raw material is molten when the amount of produced gas of smelting furnace introduced into the first half of rotary hearth furnace is varied to be increased, because the volatile component is removed from raw material in the first half of rotary hearth furnace 1 and burnt in the furnace, whereby needed caloric value is lowered. Therefore, when using such coal material containing much volatile component, it may be also preferred to control the total amount of volatile component generated in the first half of rotary hearth furnace 1 by using it after mixing with coal material containing little volatile component.

We claim:

1. A discharge apparatus for a movable hearth heat treatment furnace which discharges heat-treated products from the movable hearth heat treatment furnace to a downstream side facility, characterized in that the discharge apparatus comprises, in a casing, a recessed retaining member provided with a receiving recess for receiving and temporarily retaining the heat-treated products discharged from said movable hearth heat treatment furnace, and scraper that reciprocates along a surface of said receiving recess and discharges said heat-treated products retained in the receiving recess into said casing.

2. A discharge apparatus for a moveable hearth heat treatment furnace according to claim 1, characterized in that a seal leg is provided between said moveable hearth heat treatment furnace and said recessed retaining member, for introducing the heat-treated products discharged from said moveable hearth heat treatment furnace into the receiving recess of said recessed retaining member.

3. A discharge apparatus for a moveable hearth heat treatment furnace according to claim 2, characterized in that a gas blowing nozzle for blowing anti-reoxidation gas inert gas into said casing is communicated with said seal leg.

4. A discharge apparatus for a moveable hearth heat treatment furnace according to claim 3, characterized in that a screen sizer is provided between said moveable hearth heat treatment furnace and said seal leg, for sorting foreign substances in the heat-treated products and discharging them out of the system.

5. An apparatus for manufacturing molten iron characterized in that the apparatus comprises a movable hearth heat treatment furnace for obtaining reduced iron by reducing raw material formed by mixing at least powdered iron oxide-containing material and powdered carbonaceous reducing agent, a sorting means for removing foreign substances entrained in said reduced iron discharged from said movable hearth heat treatment furnace based on the size of the foreign substances, and a molten iron-manufacturing furnace for obtaining molten iron by melting said reduced iron in which said foreign substances have been removed by the sorting means.

6. An apparatus for manufacturing molten iron according to claim 5, characterized in that the apparatus further comprises a feeding means for feeding said reduced iron to said molten iron-manufacturing furnace while maintaining a seal with said reduced iron in which said foreign substances have been removed by said sorting means.

7. An apparatus for manufacturing molten iron according to claim 6, characterized in that said feeding means feeds reduced iron to said molten iron-manufacturing furnace by a discharged apparatus comprising, in a casing, a recessed retaining member provided with a receiving recess for receiving and temporarily retaining the reduced iron discharged from said movable hearth heat treatment furnace, and a scraper that reciprocates along a surface of said receiving recess and discharges reduced iron retained in the receiving recess into said casing.

8. An apparatus for manufacturing molten iron according to claim 5 or 7, characterized in that the apparatus comprises a gas recovery means for introducing at least a part of produced gas generated in said molten iron manufacturing furnace into said movable hearth heat treatment furnace as fuel for reduction.

9. An apparatus for manufacturing molten iron according to claim 8, characterized in that said gas recovery means introduces said produced gas into a first half of reduction of said movable hearth heat treatment furnace.

10. An apparatus for manufacturing molten iron according to claim 8, characterized in that said gas recovery means introduces said produced gas into a second half of reduction of said movable hearth heat treatment furnace.

11. An apparatus for manufacturing molten iron according to claim 8, characterized in that said gas recovery means comprises a means for removing dust from the produced gas.

12. An apparatus for manufacturing molten iron according to claim 8, characterized in that said gas recovery means comprises a means for cooling the produced gas.

13. An apparatus for manufacturing molten iron according to claim 8, characterized in that said gas recovery means comprises a means for regulating the amount of produced gas.

14. An apparatus for manufacturing molten iron according to claim 5, characterized in that said movable hearth heat treatment furnace is a rotary hearth reduction furnace.

15. A method of operating a movable hearth heat treatment furnace which discharges heat-treated products from the movable hearth heat treatment furnace to a downstream side facility, characterized in that the method comprises steps of receiving and temporarily retaining the heat-treated products discharged from said movable hearth heat treatment furnace in a receiving recess of a recessed retaining member provided in a casing; and reciprocating a scraper along a surface of said receiving recess, so that said heat-treated products temporarily retained in said receiving recess are discharged into said casing.

16. A method of operating a movable hearth heat treatment furnace according to claim 15, characterized in that anti-reoxidation gas or inert gas which at least prevents reoxidation of heat-treated products is blown into said casing.

17. A method of operating a movable hearth heat treatment furnace according to claim 15, characterized in that the heat-treated products discharged from said movable hearth heat treatment furnace are received in the receiving recess of said recessed retaining member through the internal of said seal leg.

18. A method of operating a movable hearth heat treatment furnace according to claim 17, characterized in that a blowing amount of anti-reoxidation gas or inert gas blown into said casing is controlled according to a surface temperature of said heat-treated products.

19. A method of operating a movable hearth heat treatment furnace according to claim 15, characterized in that discharge amount of heat-treated products is controlled by regulating the reciprocation number per hour of said scraper.

20. An method of manufacturing molten iron characterized in that the method comprises a reduction step of reducing raw material formed by mixing at least powdered iron oxide-containing material and powdered carbonaceous reducing agent to obtain reduced iron, a sorting step of removing foreign substances entrained in the reduced iron discharged from the reduction step based on the size of the foreign substances, and a melting step of melting said reduced iron in which said foreign substances have been removed in the sorting step, thereby obtaining molten iron.

21. A method of manufacturing molten iron according to claim 20, characterized in that the method further comprises a feeding step of feeding said reduced iron to said melting step while forming and maintaining the seal portion with said reduced iron in which said foreign substances have been removed in said sorting step.

22. A method of manufacturing molten iron according to claim 21, characterized in that said feeding step feeds said reduced iron to said molten iron-manufacturing furnace by discharge apparatus comprising, in a casing, a recessed retaining member provided with a receiving recess for receiving and temporarily retaining the reduced iron discharged from said movable hearth heat treatment furnace, and a scraper that reciprocates along a surface of said receiving recess and discharges reduced iron retained in the receiving recess into said casing.

23. A method of manufacturing molten iron according to claim 20, characterized in that the method further comprises a gas recovery step of introducing at least a part of produced gas generated in said reduction step into said reduction step as fuel for reduction.

24. A method of manufacturing molten iron according to claim 23, characterized in that said gas recovery step introduces said produced gas at a first half of said reduction step.

25. A method of manufacturing molten iron according to claim 23, characterized in that said gas recovery step introduces said produced gas at a second half of said reduction step.

26. A method of manufacturing molten iron according to claim 23, characterized in that said gas recovery step comprises a step of removing dust from the produced gas.

27. A method of manufacturing molten iron according to claim 23, characterized in that said gas recovery step comprises a step of cooling the produced gas.

28. A method of manufacturing molten iron according to claim 23, characterized in that said gas recovery step comprises a step of regulating the amount of produced gas.

29. A method of manufacturing molten iron according to claim 20, characterized in that in said reduction step, reduction is performed by a movable hearth heat treatment.

30. A method of manufacturing molten iron according to claim 20, characterized in that in said reduction step, reduction is performed by a rotary hearth reduction furnace.

* * * * *